US005156274A

United States Patent [19]

Williams, Jr. et al.

[11] Patent Number: 5,156,274

[45] Date of Patent: Oct. 20, 1992

[54] EMERGENCY BREAKDOWN ASSISTANCE KIT

[76] Inventors: John M. Williams, Jr.; Mary A. Williams, both of 7 Kimball La., Lynnfield, Mass. 01940

[21] Appl. No.: 813,108

[22] Filed: Dec. 23, 1991

[51] Int. Cl.[5] ..... G09F 21/04; B65D 71/00

[52] U.S. Cl. ..... 206/573; 40/591; 40/600; 206/818

[58] Field of Search ..... 206/573, 818; 40/591, 40/600, 621

[56] References Cited

U.S. PATENT DOCUMENTS

| | | | |
|---|---|---|---|
| 2,881,662 | 9/1956 | Harris . | |
| 2,933,841 | 4/1959 | Lawlor . | |
| 3,741,382 | 6/1973 | Larimer, Sr. | 206/573 |
| 3,791,337 | 2/1974 | Schamblin . | |
| 3,903,629 | 9/1975 | Gruna . | |
| 4,062,139 | 12/1977 | Klosel . | |
| 4,091,553 | 5/1978 | Glennie | 40/591 |
| 4,095,360 | 6/1978 | Dinan et al. . | |
| 4,108,311 | 8/1978 | McClendon | 206/573 |
| 4,178,874 | 12/1979 | Berns et al. | 40/591 X |
| 4,182,063 | 1/1980 | Klosel . | |
| 4,471,873 | 9/1984 | Thomas | 206/573 |
| 4,541,190 | 9/1985 | Weiner et al. . | |

FOREIGN PATENT DOCUMENTS

| | | | |
|---|---|---|---|
| 2143233 | 8/1971 | Fed. Rep. of Germany | 40/591 |
| 2231997 | 11/1990 | United Kingdom | 40/591 |

*Primary Examiner*—William I. Price

*Attorney, Agent, or Firm*—Cesari and McKenna

[57] ABSTRACT

Automobile emergency signaling apparatus in the nature of a kit includes an envelope having a transparent front panel. A HELP sign is mounted to an upper portion of the front panel apprising approaching motorists of an emergency situation and a plurality of trouble signs which are sized to fit in the envelope below the HELP sign indicate the specific nature of the disabled motorist's problem. To use the kit, the disabled motorist positions the applicable trouble sign in the envelope so that it faces the front panel of the envelope below the HELP sign thereon. The kit is then mounted to the automobile or other support using a magnetic strip attached to the rear panel of the envelope so that the HELP and operative trouble signs face approaching motorists. The combination of the two different signs together describe the disabled driver's particular problem and instruct the approaching motorists of the best way to alleviate the problem.

6 Claims, 2 Drawing Sheets

EMERGENCY BREAKDOWN ASSISTANCE KIT

The present invention relates generally to the signaling of emergencies, particularly at roadside. It relates more particularly to signaling apparatus in the nature of a kit which can be carried in a motor vehicle in a flat compact condition and be used by the motorist to provide visible emergency signals in the event that he or she has to stop on the roadway for one reason or another.

BACKGROUND OF THE INVENTION

Motorists are often stopped at roadside due to a mechanical failure of the vehicle or to the sickness of an occupant of the vehicle or for various other reasons. When this occurs, it is sometimes quite difficult for the motorist to apprise other motorists of his or her predicament in order to summon the proper kind of assistance. This is particularly so on the larger interstate highways where traffic travels in divided lanes at high speeds. By the time the approaching driver notices the disabled vehicle, it is often too late to pull over and stop to provide the requisite assistance.

There do exist various types of warning signs and displays which are intended to be carried in the automobile and to signal an emergency situation. Most of the prior devices of this general type are simply bright or reflective cards, cones or panels that can be stood upright in the road behind the disabled automobile to give the approaching traffic advance warning of the presence of that vehicle; see U.S. Pat. Nos. 2,881,662 and 4,182,063, for example. Usually these devices have no capacity for conveying any specific information about the disablement. There are some prior displays and signaling devices that are designed to be suspended; see, e.g., U.S. Pat. Nos. 2,933,841, 3,791,337 and 4,095,360. However, they are usually lightweight and made of paper or cardboard so that they have to be supported by special hangers or brackets to avoid being blown over by wind and damaged by the elements. Such supporting components increase the overall cost of those prior signalling devices. Finally, conventional signaling devices and kits tend to be relatively expensive to make, the available signals are limited and they are difficult to use, particularly at night and in cold weather when the motorist's hands might be cold and unable to manipulate the components of the devices in order to erect and position them where they can be seen by approaching traffic.

SUMMARY OF THE INVENTION

Accordingly, it is an object of the present invention to provide improved apparatus in the nature of a kit for signaling automobile emergencies from roadside.

Another object of the invention is to provide emergency signaling apparatus which may be stored compactly in the motor vehicle until needed and be positioned readily to display an emergency signal selected from a plurality of available signals.

A further object of the invention is to provide an automobile emergency signaling kit whose signals are clearly visible day or night.

Still another object of the invention is to provide a kit of this type which is relatively inexpensive to make.

Another object of the invention is to provide such a kit which is easy to use even in the dark and in inclement weather.

Yet another object of the invention is to provide an automobile emergency signaling kit whose components should have a long useful life even after the kit has been exposed repeatedly to the weather and stored for a prolonged period in a closed space such as an automobile trunk.

A further object of the invention is to provide signaling apparatus of this general type which can signal a wide variety of different emergency situations to approaching motorists.

The invention accordingly comprises the features of construction, combination of elements and arrangement of parts which will be exemplified in the following detailed description, and the scope of the invention will be indicated in the claims.

Briefly, the present apparatus or kit comprises a relatively large flat transparent envelope containing a plurality of card-like signs and one or more knock-down or collapsible warning devices adapted to be placed upright on the road or on the vehicle itself. The envelope and its contents form a flat compact package or kit which can be stored under the front seat of the vehicle or in the vehicle trunk where the kit will be available in the event of a roadside emergency. If such should occur, the kit can be retrieved and mounted to the automobile or to another convenient support at roadside so as to present an appropriate emergency signal to approaching motorists.

The kit envelope includes an emergency signalling sign displaying a word such as HELP or SOS, mounted to the front of the envelope which enables a disabled driver to signal approaching motorists that an emergency situation exists. The envelope also holds so-called trouble signs which carry words or symbols indicating the specific nature of the disabled motorist's problem. The present kit contains several different trouble signs signaling a flat tire, dead battery, the need for gas, a tow truck, the police, and the like. The combination of the emergency signalling sign, referred to hereinafter as a HELP sign, and a trouble sign displayed simultaneously by a stranded driver will immediately tell approaching motorists exactly what is required by that driver. Thus, those motorists can make appropriate and timely decisions which will result in the right assistance reaching the driver in the shortest time.

For example, using the kit, the disabled motorist can display a HELP sign in the upper area of the envelope and a RED CROSS symbol in the lower area thereof. This immediately tells the oncoming motorists to provide or obtain medical assistance for the disabled driver. On the other hand, if the kit displays HELP along with a GAS PUMP symbol, this apprises each approaching motorist that the disabled driver requires assistance in obtaining gas. The ability of the present apparatus to display simultaneously both a HELP sign and a trouble sign permits the disabled driver to covey more information than is possible with conventional emergency signals and signs of this general type which display a signal message. Indeed, the present kit contain trouble signs describing the requirements of most for the common roadside emergencies, such as gas, police, medical assistance, tow truck, tire repair and battery jump.

The envelope component of the kit is made of a strong, rugged, tear-resistant transparent plastic sheet material which is substantially impervious to moisture and the elements. The HELP sign has a highly reflective background and the sign is preferably mounted to a wall of the envelope, e.g., the front wall. The trouble signs are stiff, moisture-resistant cards whose surface carry fluorescent coatings so that the symbols and words on the trouble signs stand out. When it is desired to display a particular trouble sign, that side is positioned in the envelope so that it is next to and visible through the same wall of the envelope just below the HELP sign thereon. A magnetic strip is mounted to the opposite wall of the envelope so that the envelope and its contents can be suspended magnetically from the back of the disable vehicle or from some other ferromagnetic structure, with the emergency messages facing the approaching traffic.

In addition to the HELP and trouble signs, the kit may contain other types of signaling devices which complement the signs and each other. A preferred kit includes one or more warning markers or standards which can be stood upright in the road or highway behind the disabled vehicle to warn motorists on the same side of the road that a disabled vehicle is ahead. These markers are preferably brightly colored an have reflective or fluorescent areas so that they are readily visible even at night. Desirably also, the markers can be collapsed or knocked down so that they lie flat in the envelope when the kit is stored away.

BRIEF DESCRIPTION OF THE DRAWINGS

For a fuller understanding of the nature and objects of the invention, references should be had to the following detailed description, taken in connection with the accompanying drawing, in which.

DETAILED DESCRIPTION OF THE PREFERRED EMBODIMENT

Figure 1:
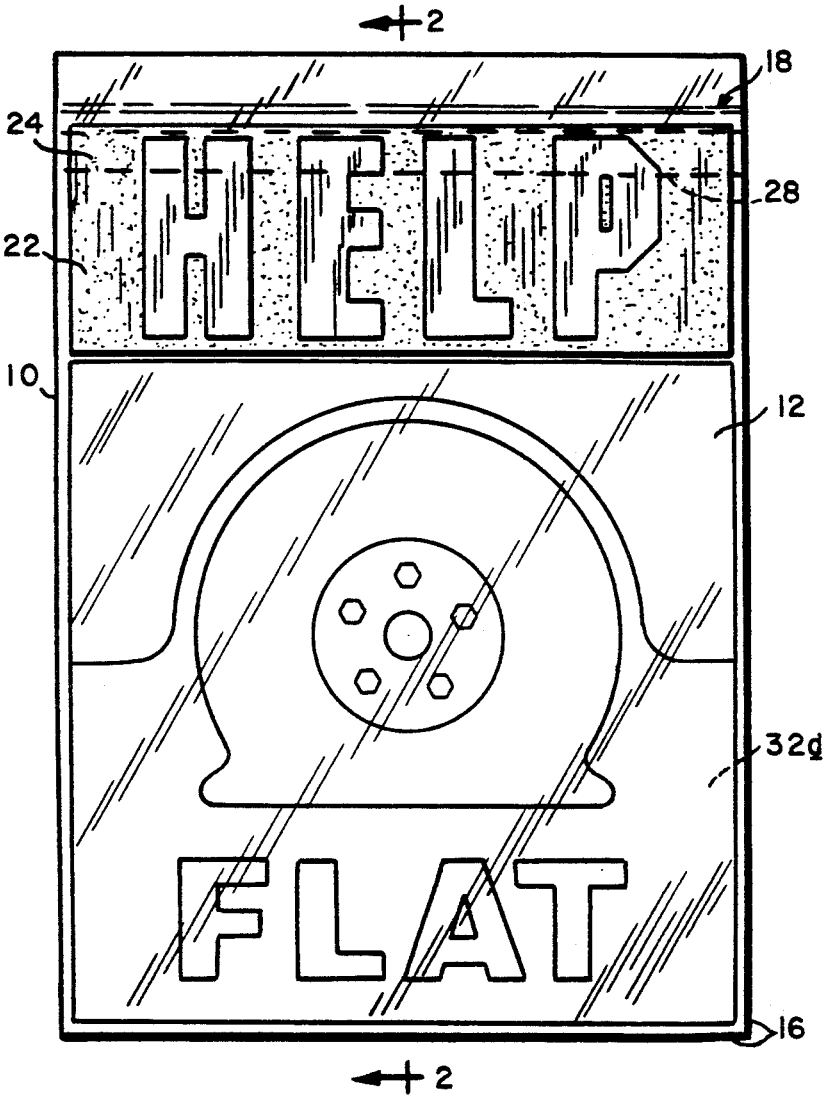
FIG. 1 is a front view of an emergency signalling kit incorporating our invention, with the kit shown in its working condition.
Figure 2:
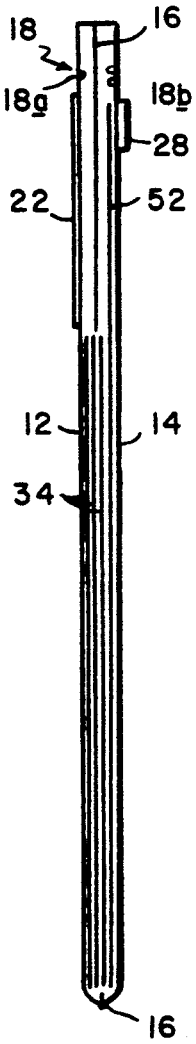
FIG. 2 is a sectional view taken along line 2—2 of FIG. 1 with the kit envelope being shown in its open condition.

Referring to FIGS. 1 and 2 of the drawing, the subject kit comprises a generally rectangular envelope or holder lo made of a rugged, tear-resistant, transparent plastic sheet material such as polyethylene. The envelope has a front wall or panel 12 and a similar rear wall or panel 14 which are joined at the side and bottom edges by heat welds or seams 16. The envelope is open at the top, but may be closed by a conventional plastic zipper 18 extending along the top of the envelope, the male component 18*a* of the zipper being on one panel and the female component 18*b* being on the other panel. Typically envelope 10 is in the order of fifteen inches high and eleven inches wide.

Permanently mounted to the front panel 12 of the envelope 10 just under zipper 18 is an emergency signalling or HELP sign 22. Preferably, the sign comprises a strip of flexible waterproof tape 22 bearing the word HELP superimposed on a highly reflective contrasting color background indicated by stippling 24. The tape is adhered to panel 12, preferably on the outside surface thereof, so that the HELP sign is clearly visible on the outside of the envelope. The tape 22 should extend substantially the full width of the envelope and have a width so that it extends down on panel 12 about four inches from zipper 18.

Adhered to the rear panel 14 of envelope 10 just below zipper 18 is a flexible magnetic mounting strip 28 which extends substantially the full width of envelope 10 opposite tape 22. The magnetic attraction of that strip for a ferromagnetic structure such as an automobile body is strong enough to support envelope 10 and its contents to be described, even in the presence of high winds and driving rain.

Figure 3:
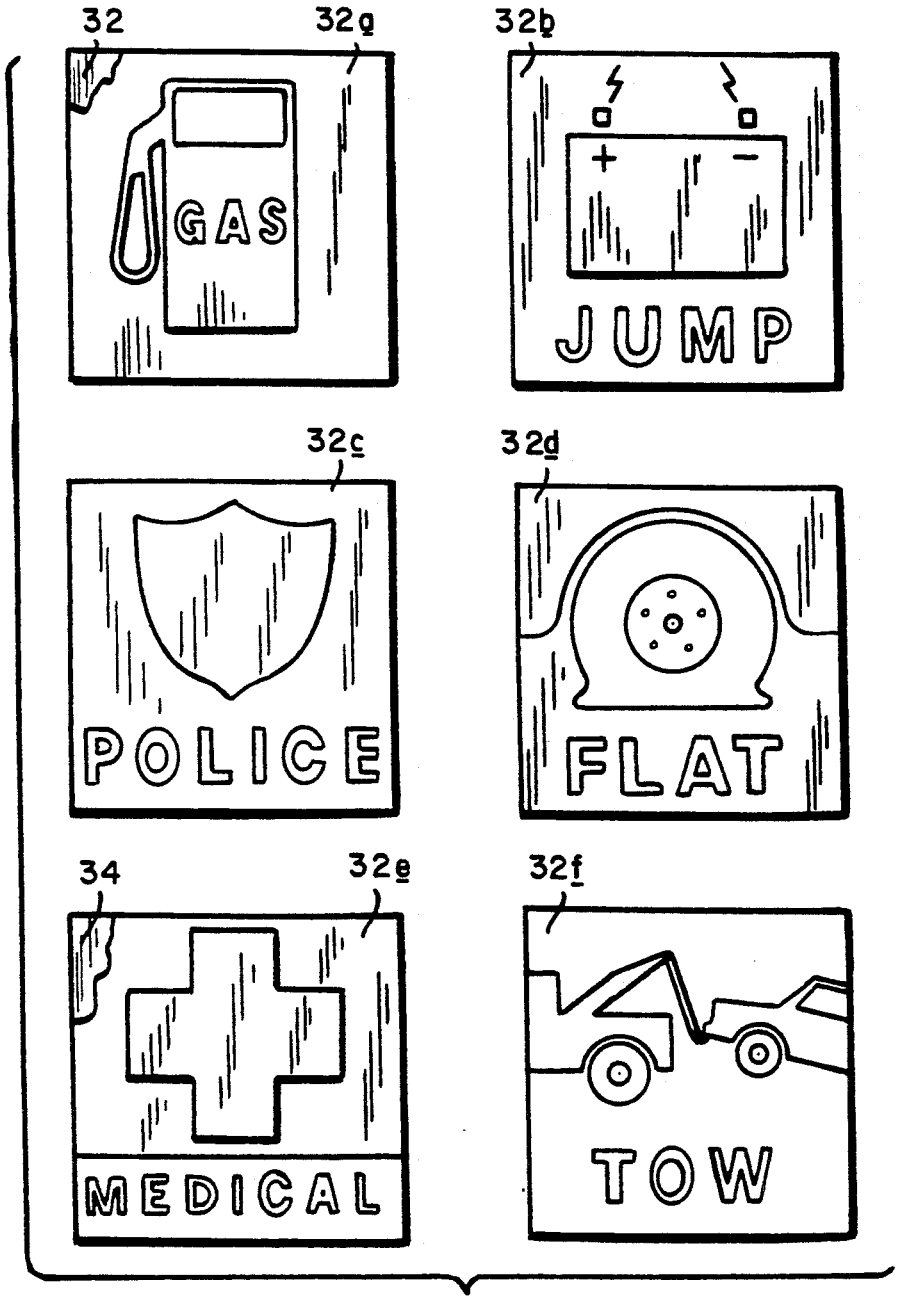
FIG. 3 illustrates the trouble sign components of the FIG 1. kit.

The remaining components of our kit are designed to be contained in the envelope 10, most of these components being illustrated in FIG. 3. They include so-called trouble signs 32*a* to 32*f* which display different words and/or symbols which indicate the nature of the assistance required by the disabled motorist such as medical assistance, police assistance, towing assistance, etc. The kit specifically illustrated herein contains six trouble signs printed on relatively stiff cards 34. However, a different number of signs may be included depending upon the nature of the terrain and the particular part of the country being traveled. The six illustrated trouble signs 32*a* to 32*f* signal the assistance most commonly sought by a disabled motorist. Each of the cards 34 comprising signs 32*g* to 32*f* is about eleven a side so that it can be slid easily into and from envelope 10 through the top opening thereof when the envelope is in its open condition shown in FIG. 2.

The signs depicted in FIG. 3 are actually printed on opposite sides of only three cards 34. The card surfaces are silk screened, printed, or otherwise colored to outline areas to form symbols and/or words that immediately convey a definite meaning to the average motorist or passerby. Thus, for the trouble sign 32*f* depicted in FIG. 1, one side of a card 34 is screened or otherwise colored to define the outline of an automobile with a flat tire. Likewise, the remaining signs display other words or symbols which are recognized universally as signaling certain emergency conditions or requests. Preferably, day-glo or fluorescent colors are used for the backgrounds of the signs 32*a* to 32*f* so that the signs will be very visible and readable both in the daytime and at night when illuminated by the headlights of an approaching vehicle.

The various trouble signs are not intended to be used by themselves, but rather in conjunction with the fluorescent or reflective HELP sign 22 shown in FIG. 1. As noted above, cards 34 comprising signs 32*a* to 32*f* are about eleven inches high. Thus, when inserted into envelope 10, which is about fifteen inches high, the sign closest to front panel 12 of the envelope will be exposed through that panel just below the HELP sign 22 thereon. Consequently, both of those signs (e.g., signs 22 and 32*f* in FIG. 1) will be presented in their entireties to oncoming motorists.

Normally, all of the trouble signs, i.e., cards 34, are stored in envelope 10, but only the operative sign facing envelope panel 12 is visible to an observer. In FIG. 1, this is sign 32*f*. The other signs in the envelope are hidden from view behind the operative sign as shown in FIGS. 1 and 2.

The trouble cards 32*a* to 32*f* are arranged to be superimposed and inserted into envelope 10 with only one of the signs facing the transparent front panel 12 so that only that first or frontmost sign is visible.

Figure 4:
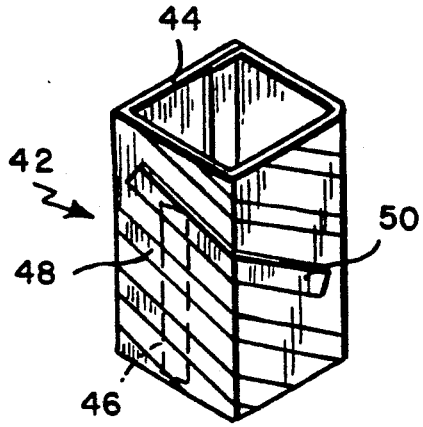
FIG. 4 is an isometric view of a road marker component of the FIG. 1 kit.

Envelope 10 may also contain one or more collapsible or foldable road markers or standards, one of which is shown generally at 42 in FIG. 4. Each such standard comprises a tube 44 which can be folded flat so that it may be slid into envelope 10 or can be squared up as shown in FIG. 4 so that it may stand erect on the roadway. Tube 44 is dimensioned so that it can fit over a standard two-liter tonic bottle, an oil can or some other such supporting container often found in a vehicle. So weighted, the road marker will remain upright even in the presence of high winds. If desired, the particular supporting container can be filled with water or sand to make the standard even more stable. Also, a magnetic strip may be affixed to a wall of tube 44 as shown in phantom at 46 in FIG. 4 so that the signaling device 42 may be removably mounted to the roof of the disable car or to another such metal object. In any event, the outside surface of each tube 44 is coated or covered with very bright orange or red spaced-apart diagonal strips 48 which are customarily used to signal danger. To add further to the visibility of the marker, one or more fluorescent or reflective strips 50 may be adhered to the outside of the tube so that the strips will be visible from all sides of the marker 42.

Some kits may also include an advertising and instruction card 52 as shown in FIG. 2. This card may extend to almost the full height of envelope 10 and is usually positioned adjacent to the rear panel 14 so that advertising pictures and text on one side of that card are visible through panel 14. Text on the opposite side of that card may instruct the disabled driver how to use the various components of the kit.

Normally, the above-described trouble sign and road marker components of the kit are stored in a flattened condition inside envelope 10 and the envelope is stored flat in a convenient place in the vehicle such as under the front seat or in the trunk. When an emergency situation occurs, the motorist simply opens the envelope and, depending upon the particular situation, places one of the trouble signs 32*a* to 32*f* so that it faces envelope panel 12. All of the kit's other signs and signaling devices remain out of sight behind the card 34 of that operative sign. The motorist then hangs the kit 10 via its magnetic strip 28 at a location where the exposed signs will be readily visible to approaching motorists. For example, the kit may be mounted on the back of the vehicle's trunk or on the side of the car under one of the side windows. Alternatively, if a metal guard rail is handy, the kit can be mounted to that rail up the road from the disable vehicle so that its signs face the approaching or passing drivers.

It is important to note that it is the display of the two different types of signs 22 and 32 simultaneously that provides the necessary information in the short amount of time available to an approaching motorist to enable him to make the proper decision. If the kit displayed only a single sign as is done conventionally, either the sign would not apprise the approaching motorist of the nature of the disable driver's predicament or it would contain so much information that the motorist would be unable to read the sign and learn of the problem before passing the scene. This is especially so on many major interstate highways where the traffic flows in only one direction. In such circumstances, it would be too late for the passing motorist to stop even if he were in a position to provide the proper assistance to the disabled driver.

Thus, the present kit offers distinct advantages over prior comparable signaling devices of this general type by conveying a maximum amount of information to the approaching motorist in the brief time that is available to that motorist to react to the given situation in a manner that will bring the correct assistance to the disabled driver in the shortest possible time.

If, for the particular emergency situation, use of the kit's other signaling devices, such as a marker 42, is appropriate, they may be removed from the kit envelope and erected in the roadway or elsewhere to best apprise passersby of the emergency condition.

It will be seen from the foregoing, then, that the automobile emergency signaling kit described herein permits a driver to provide a clear and visible signal as to whether motorists should stop and provide immediate assistance or continue on to find appropriate help. The kit also enables the driver to indicate or signal the precise nature of the assistance required. It is the combination of these two different types of signaling signs that enables a passing motorist to decide before it is too late whether he himself is able to provide the assistance requested or whether he should continue on to a telephone or to a place where such assistance can be found or summoned and directed back to the disabled motorist.

It is apparent from the foregoing also that the components of applicant's kit are quite simple to make since they can be cut from inexpensive sheet material and formed or assembled using conventional inexpensive adhesives and heat welds. Since the envelope 10 enclosing various signs and markers is made of rugged, tear-resistant, plastic material, it is substantially impervious to the weather and to oils and greases that are often preset in an automobile trunk where the kit may be stored. Also, the components of the kit within the envelope are well protected.

Accordingly, the apparatus described herein should prove to be a very valuable and highly effective device for minimizing inconvenience and injury to motorists because it will enable a disabled motorists to receive the correct assistance in the minimum amount of time. Consequently, the disable vehicle can be removed from the scene as quickly as possible so that the vehicle does not present a danger to traffic on the roadway.

It will thus be see that the objects set forth above, among those made apparently from the preceding description, are efficiently attained, and, since certain changes may be made in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. An automobile emergency signaling apparatus in the nature of a kit comprising a flat envelope composed of superimposed, co-extensive, generally rectangular, flexible, plastic, front and rear panels seamed together along three edges of said panels, said front panel being transparent;

coacting closure means on the opposing faces of said panels adjacent to the fourth edges thereof and extending uninterruptedly along those edges for releasable sealing together said panels;

a flexible emergency signaling sign mounted to said front panel at an upper area thereof;

a plurality of card-like trouble signs sized to fit in said envelope below the level of said signaling sign with a selected one of said trouble signs facing and being visible through said front panel, said trouble signs bearing different indicia indicating a particular type of assistance often required by a disabled driver so that when the apparatus is supported with the envelope front panel facing a roadway, the combination of the emergency signaling sign and the selected trouble sign apprise passing motorists of the emergency condition and the type of assistance required by the disabled driver, and mounting means on the rear panel of the envelope opposite the emergency sign thereon from affixing the kit to a support.

2. The signaling apparatus defined in claim 1 wherein said coacting closure means comprises male and female components of a plastic zipper formed integrally in said panels.

3. The signaling apparatus defined in claim 1 wherein said mounting means include a flexible magnetic strip adhered to said rear panel opposite said emergency signaling sign.

4. The signaling apparatus defined in claim 1 wherein said trouble signs comprise a plurality of cards whose areas correspond more or less to the area of said envelope front panel below the emergency signaling sign thereon, and said indicia are constituted by light-reflective surface coatings on opposite faces of said cards.

5. The signaling apparatus defined in claim 4 and further including a collapsible tube in said envelope, and warning or signaling indicia on the outer surface of said tube.

6. The signaling apparatus defined in claim 5 and further including magnet means affixed to an outer surface of said tube.

* * * * *

UNITED STATES PATENT AND TRADEMARK OFFICE

CERTIFICATE OF CORRECTION

PATENT NO. : 5,156,274

DATED : October 20, 1992

INVENTOR(S) : John M. Williams, et al

It is certified that error appears in the above-indentified patent and that said Letters Patent is hereby corrected as shown below:

Col. 7, Claim 1, line 26, change "from" to --for--.

Signed and Sealed this

Twenty-first Day of September, 1993

Bruce Lehman

*Attest:*

BRUCE LEHMAN

*Attesting Officer*

*Commissioner of Patents and Trademarks*